US010369455B2

(12) United States Patent
Faith

(10) Patent No.: US 10,369,455 B2
(45) Date of Patent: Aug. 6, 2019

(54) TICKET REDEMPTION GAME AND ASSOCIATED METHOD

(71) Applicant: Bill Faith, Northridge, CA (US)

(72) Inventor: Bill Faith, Northridge, CA (US)

( * ) Notice: Subject to any disclaimer, the term of this patent is extended or adjusted under 35 U.S.C. 154(b) by 57 days.

(21) Appl. No.: 15/345,224

(22) Filed: Nov. 7, 2016

(65) Prior Publication Data

US 2018/0126258 A1 May 10, 2018

(51) Int. Cl.

| | |
|---|---|
| ***A63F 7/38*** | (2006.01) |
| ***A63F 7/02*** | (2006.01) |
| ***A63F 7/26*** | (2006.01) |
| ***A63F 7/28*** | (2006.01) |
| *A63F 7/36* | (2006.01) |

(52) U.S. Cl.

CPC ..... *A63F 7/38* (2013.01); *A63F 7/022* (2013.01); *A63F 7/26* (2013.01); *A63F 7/28* (2013.01); *A63F 2007/3648* (2013.01)

(58) Field of Classification Search

CPC .... A63F 7/022; A63F 7/02; A63F 7/22; A63F 7/38; A63F 3/06; A63F 3/0645

See application file for complete search history.

(56) References Cited

U.S. PATENT DOCUMENTS

| | | | | |
|---|---|---|---|---|
| 1,996,143 | A * | 4/1935 | Callison | G07F 17/3297 194/205 |
| 2,032,677 | A * | 3/1936 | Watson | A63F 5/0088 273/121 B |
| 3,643,951 | A | 2/1972 | Breslow | |
| 4,094,507 | A | 6/1978 | Kauffmann | |
| 4,248,427 | A | 2/1981 | Vierimaa | |
| 4,846,476 | A | 7/1989 | Hanna | |
| 5,121,920 | A | 6/1992 | Laezzo et al. | |
| 5,639,089 | A * | 6/1997 | Matsumoto | A63F 3/062 273/138.2 |
| 5,785,594 | A * | 7/1998 | Seibert, Jr. | A63F 5/04 273/138.2 |
| 5,845,903 | A * | 12/1998 | Sloan | A63F 7/048 273/144 R |
| 6,152,448 | A | 11/2000 | Cudlipp | |
| 6,257,573 | B1 * | 7/2001 | Munoz | A63F 7/02 273/120 A |
| 6,390,470 | B1 | 5/2002 | Huang | |
| 7,727,065 | B2 * | 6/2010 | Seelig | G07F 17/3244 273/138.2 |
| 8,702,104 | B2 | 4/2014 | Legary et al. | |

FOREIGN PATENT DOCUMENTS

JP 05192435 A * 8/1993

OTHER PUBLICATIONS

Machine translation obtained from EPO.org of JP 05192435, available at http://translationportal.epo.org/emtp/translate/?ACTION=description-retrieval&COUNTRY=JP&ENGINE=google&FORMAT=docdb&KIND=A&LOCALE=en_EP&NUMBER=H05192435&OPS=ops.epo.org/3.2&SRCLANG=ja&TRGLANG=en, last accessed May 31, 2018.*

* cited by examiner

*Primary Examiner* — Jay Trent Liddle
(74) *Attorney, Agent, or Firm* — Tobin Hobbs

(57) ABSTRACT

A ticket redemption game having an upright cabinet. The upright cabinet houses a cylindrical drum which may be rotated through the use of a control by at least one electric motor. In the interior of the cylindrical drum are a plurality of balls. When the drum is rotated, the plurality of balls is moved from a low point to an apex of the cylindrical drum along an interior circumference of the cylindrical drum by the aid of traction elements.

20 Claims, 6 Drawing Sheets

TICKET REDEMPTION GAME AND ASSOCIATED METHOD

CROSS-REFERENCE TO RELATED APPLICATIONS

Not Applicable

STATEMENT RE: FEDERALLY SPONSORED RESEARCH/DEVELOPMENT

Not Applicable

BACKGROUND

Ticket redemption games are well known, and have been placed in amusement centers, arcades, and restaurant arcades for some time. Many of the games involve balls, including the well know Skee Ball game where a user bowls balls down an alley to a ramp, which launches the balls upward to a field of play with target areas. The field of play is somewhat of a cross between a dart board and a basketball hoop. In such a game, each instance of play involves the rolling of a single ball.

Other games may use a plurality of objects including balls, and the player uses them to achieve various goals, and redeem a number of tickets corresponding to the achievement of the goals. One goal, may be, for example, to move as many of the objects from one place to another given a fixed number of opportunities. In other examples, the goal may be to move as many of the objects to a plurality of locations as possible in a fixed amount of time.

The movement of the objects has often been either manual, that is the rolling or tossing of the ball by a user, or through the use of a mechanical device operated by a user, such as may be the case with a pinball launcher or flippers. Still others may use a combination of a manual location set by a user, and then the machine executes an automated movement.

Almost exclusively, prior art games move the ball or plurality of objects in a linear path. Players or users are always in search of games which offer fresh manners of game play, including differing paths for objects within the game.

BRIEF SUMMARY

Disclosed is a ticket redemption game operating in an upright cabinet. The upright cabinet houses a cylindrical drum which may be rotated through the use of a control. The control operates at least one electric motor connected to the drum. In an interior of the cylindrical drum are a plurality of balls. When the drum is rotated, the plurality of balls is moved from a low point to an apex of the cylindrical drum along an interior circumference of the cylindrical drum by the aid of traction elements. The plurality of balls then falls under the force of gravity in to a field of play. In the field of play, the plurality of balls may encounter at least one retention element, which may be either a tray or a tube, or both. Upon completion of a round of play the retention elements are emptied, returning a portion of the plurality of balls retained by the retention elements to the low point of the drum.

More specifically, disclosed is a ticket redemption game, comprising a cabinet, and a cylindrical drum placed inside the cabinet. The cylindrical drum defines an apex, a low point, and an interior circumference. A plurality of traction elements is attached to the interior circumference at regular intervals.

Further disclosed is a field of play, separated from the cylindrical drum by a gap. The field of play comprises at least one retention element.

A plurality of balls are placed within the cylindrical drum, and a control is located on an exterior of the cabinet and connected to the cylindrical drum.

When a user operates the control, the control allows the user to rotate the cylindrical drum selectively clockwise or counterclockwise. When the cylindrical drum is rotated, the cylindrical drum and the traction elements carry the plurality of balls from the low point to the apex, and from the apex, the plurality of balls fall, under the force of gravity, through the field of play. The field of play includes at least one retention element, and if one of the plurality of balls is not captured by the at least one retention element, the one of the plurality of balls returns to the low point under the force of gravity.

Further disclosed is a ticket redemption game further comprising a countdown clock.

Further disclosed is a ticket redemption game, further comprising at least one electric motor for rotating the cylindrical drum.

Further disclosed is a ticket redemption game, further comprising two electric motors for rotating the drum, wherein each electric motor rotates the drum in a single direction.

Further disclosed is a ticket redemption game, wherein the field of play is fixed to an axle.

Further disclosed is a ticket redemption game, further comprising an electric motor connected to a chain.

Further disclosed is a ticket redemption game, wherein the chain turns the axle to rotate the field of play.

Further disclosed is a ticket redemption game, wherein the electric motor is controlled by a central processing unit.

Further disclosed is a ticket redemption game, wherein the control is a rotatable handle.

Also disclosed is a ticket redemption game, comprising, a cabinet, and a cylindrical drum placed inside the cabinet. A plurality of traction elements are attached to an interior circumference of the rotating cylindrical drum.

A field of play is separated from the rotating cylindrical drum by a gap.

A first electric motor is connected to the rotating cylindrical drum, and configured to rotate the rotating drum exclusively clockwise, and a second electric motor connected to the drum, and configured to rotate the drum exclusively counterclockwise; and, finally, a third electric motor connected to the field of play, and configured to rotate the field of play.

Further disclosed is a ticket redemption game, wherein the first electric motor is connected to the cylindrical drum by a belt and second electric motor is connected to the cylindrical drum by a belt.

Further disclosed is a ticket redemption game, wherein the belts are placed in slots in a common gear.

Further disclosed is a ticket redemption game, further comprising fingers attached to at least one of the traction elements.

Further disclosed is a ticket redemption game, further comprising fingers attached to half of the traction elements.

Further disclosed is a ticket redemption game, further comprising at least one retention element attached to the field of play.

Further disclosed is a ticket redemption game, further comprising at least one retention tube attached to the field of play.

Further disclosed is a ticket redemption game, further comprising a card reader electrically connected to a central processing unit.

Also disclosed is a method for manufacturing a ticket redemption game, comprising adding a cabinet, placing a cylindrical drum inside the cabinet, the cylindrical drum defining an interior circumference, and arranging a plurality of traction elements around the interior circumference;

placing a plurality of balls in the cylindrical drum.

The method further discloses connecting the drum to at least one electric motor, connecting, electrically, the two electric motor to a central processing unit, and connecting, electrically, the central processing unit to a user control.

Further disclosed is a method, wherein at least one of the plurality of traction elements comprises at least one finger.

Further disclosed is a method, wherein the plurality of balls comprise balls of at least three colors.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
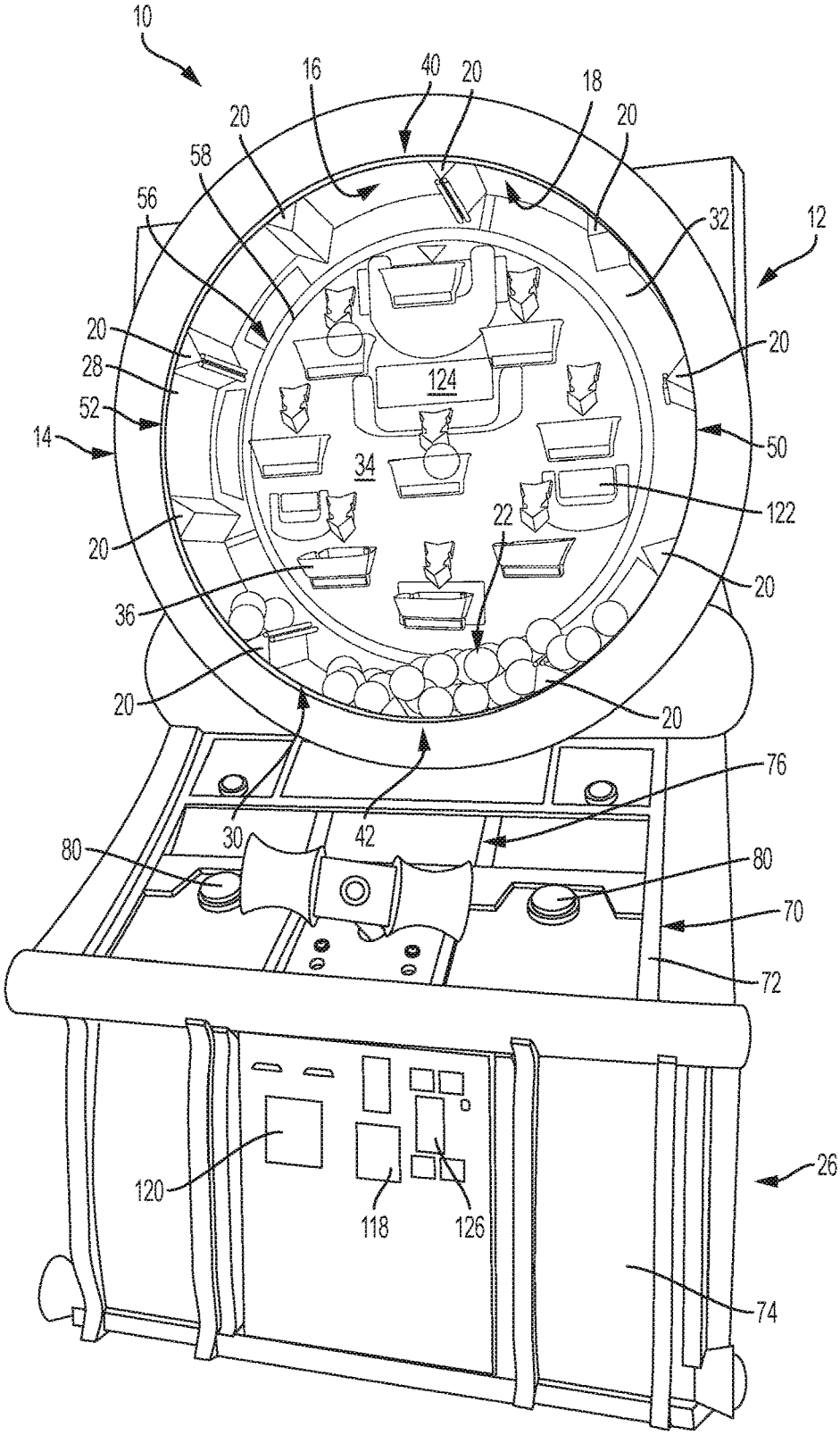
FIG. 1 shows a perspective view of the ticket redemption game.
Figure 2:
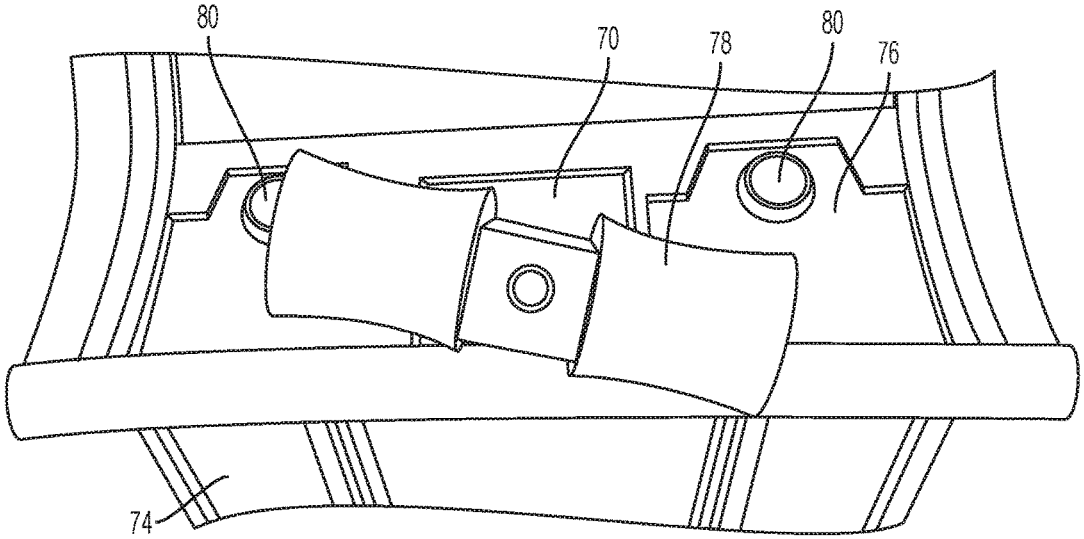
FIG. 2 shows a detail view of a control for the cylindrical drum of the ticket redemption game of FIG. 1.
Figure 3:
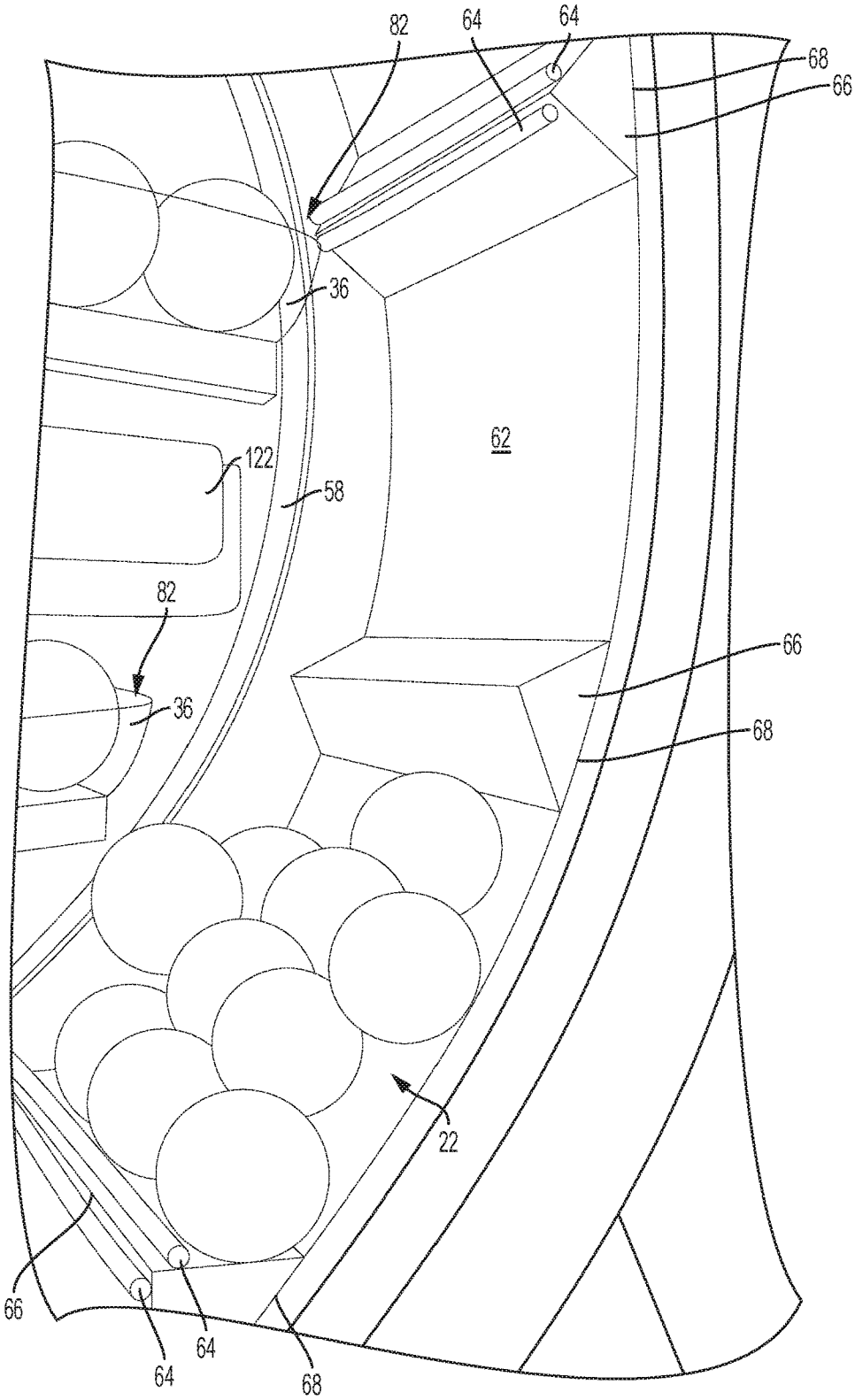
FIG. 3 shows a detail view of the traction elements of the ticket redemption game of FIG. 1.
Figure 4:
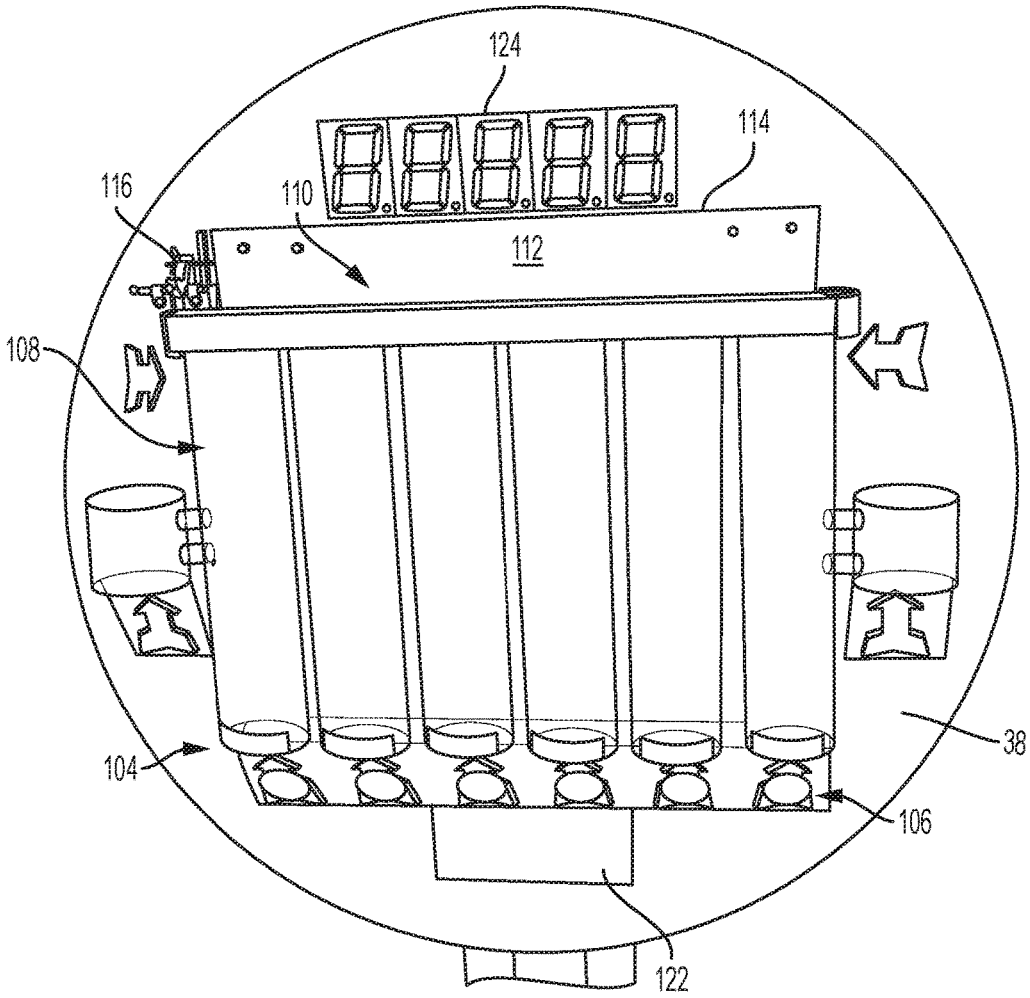
FIG. 4 shows an alternate embodiment of the field of play of the ticket redemption game.
Figure 5:
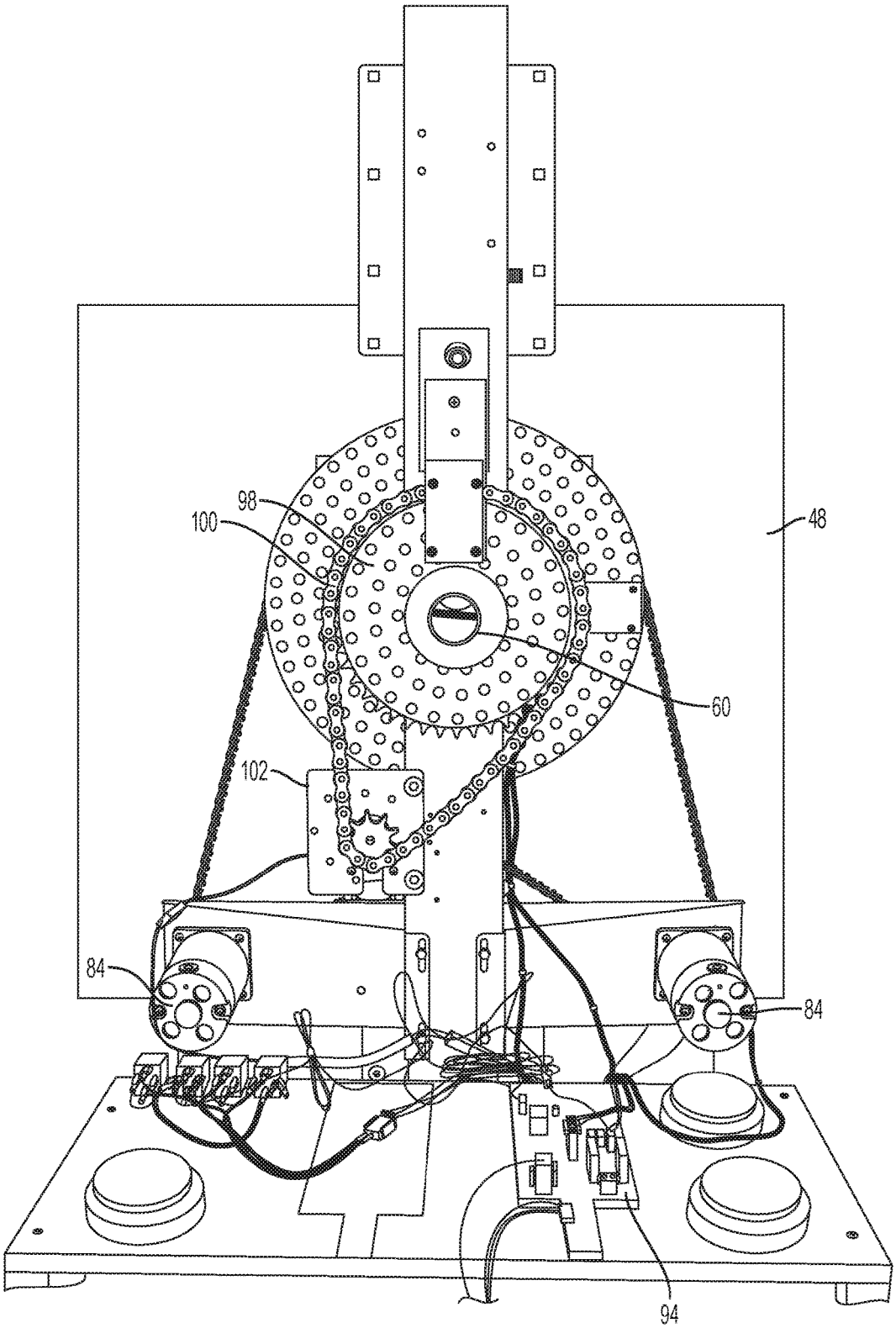
FIG. 5 shows a perspective view of the mechanical elements of the ticket redemption game.
Figure 6:
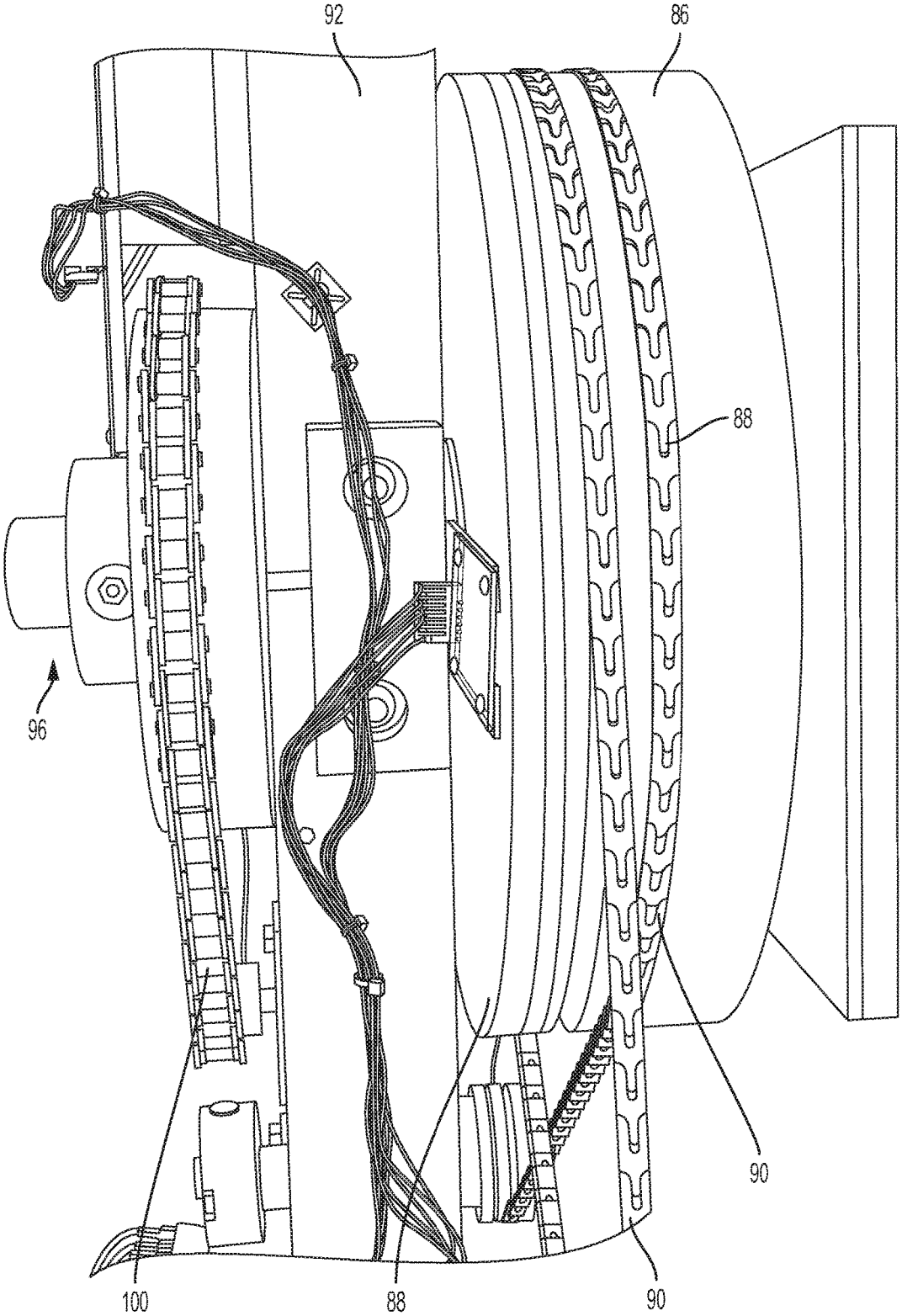
FIG. 6 shows a side detail view of some of the mechanical elements of the ticket redemption game.

With reference to FIGS. 1-6, disclosed is a ticket redemption game 10 having an upright cabinet 12. In an upper section 14 of the cabinet is housed a cylindrical drum 16. Placed at intervals around an interior circumference 18 of the cylindrical drum are a plurality of traction elements 20 for gripping a plurality of balls 22. A user (not shown) may use controls 76 mounted on a lower section 26 of the upright cabinet to rotate the cylindrical drum clockwise or counter clockwise. A proximal end 28 of the cylindrical drum is open and corresponds to an aperture 30 in the upright cabinet which a user may see through in order to play the game. A distal end 32 of the cylindrical drum is fixed, and separated from the remainder of the drum by a gap. The distal end of the cylindrical drum is also called a field of play 34. Mounted on the field of play may be retention elements, which may include at least one tray 36 or at least one retention tube 38 or any combination thereof.

When the cylindrical drum 16 is rotated, the plurality of balls 22 within the cylindrical drum are gripped by the plurality of traction elements 20 and moved to an apex 40 of the cylindrical drum. From the apex, gravity causes the plurality of balls to fall downward toward a low point 42 of the cylindrical drum. As the plurality of balls fall through the field of play 34, at least some of the plurality of balls encounter the at least one tray 36 or at least one retention tube 38 or any combination thereof on the field of play and one or more of the plurality of balls may be retained on the field of play. Sensors 44 detect the location and color of the retained ones of the plurality balls. The sensors emit light, and depending on the amount and color of the light reflected to a detector on the sensor, the sensor can determine both the presence and color of a ball. The sensors are connected to a central processing unit (cpu) 94 which operates several aspects of game play, including calculating the score and keeping track of time. The cylindrical drum may be rotated several times by a user until the field of play is filled with balls from the plurality of balls or time runs out. After a round of gameplay ends, the field of play may be rotated by the cpu to return the balls retained in the at least one tray or at least one retention tube, or any combination thereof to the low point of the cylindrical drum.

In a first embodiment, the ticket redemption game 10 comprises an upright cabinet 12, also called simply a cabinet, which rests upon a horizontal surface such as a floor. A cabinet, which mounts on or rests against a vertical surface, such as a wall, or against inclined surfaces is also contemplated.

In an interior 48 of the cabinet 12 may be mounted a cylindrical drum 16, or just a drum. The drum is substantially cylindrical in shape, the drum defining a longitudinal axis, which is generally horizontal, about which the drum rotates, and an interior 56 of the drum defining an interior circumference 18. The interior circumference defines an apex 40 and a low point 42, with a first transition area 50 and a second transition area 52 forming 180 degree arcs to either side of a line defined by the apex and the low point. A play aperture 30 in the cabinet substantially equal to the interior circumference allows a user (not shown) to see the interior of the drum. Play apertures smaller and larger than the interior circumference are also contemplated. The aperture may be covered by a translucent material, such as plexiglass, tempered glass, or any other sufficiently translucent material that will withstand the continued contact of objects within the drum. An exterior surface of the drum may or may not be visible to a user of the game through the aperture. When the exterior surface is not visible, the cabinet is sized and shaped to cover the exterior surface of the drum. The ability of a user to see the exterior of the drum does not affect the operation of the game by the user.

Inset some distance from the interior circumference 18 may be a field of play 34. The field of play is separated from the remainder of the drum 16 by a gap 58 and mounted on an axle 60. Thus, due to the gap and the mounting on a axle, as the drum rotates, the field of play remains stationary. Between rounds of game play, the field of play may be separately rotated from the remainder of the drum. The field of play may be rotated about the horizontal axis at least 90 degrees in one of the clockwise or counterclockwise direction.

Several components are placed in the interior 56 of the drum 16. Around the interior circumference 18 of the drum are placed a plurality of traction elements 20, which are designed to engage a plurality of balls 22. The plurality of traction elements prevent of the plurality of balls from sliding on and around the interior circumference of the drum and, therefore, not being carried to the apex 40 of the drum when the drum is rotated. Each of the plurality of traction elements is sized to engage at least one of the plurality of balls. The plurality of traction elements are evenly spaced around the interior circumference of the drum. In other embodiments, the traction elements may be spaced unevenly around the interior circumference of the drum.

Each of the plurality of traction element 20 may be shaped as a prism. The prism is mounted to a surface 62 corresponding to the interior circumference 18 of the drum 16. Each of the plurality of traction elements is mounted such that one side of the prism attaches to the surface corresponding to the interior circumference of the drum, with the longitudinal axis of the prism aligned such that the longitudinal axis of the prism is parallel to the horizontal axis of the drum. The traction element may be made of a polymer, or a less dense metal, or any material with provides sufficient friction to grip a surface of one of the plurality of ball 22s, and has light enough weight to not impede the rotation of the cabinet such that the plurality of balls within the interior of drum are not carried to the drum apex 40.

Additionally, one or two cylindrical elements 64 may be placed to either side of a tip 66 of at least some of the plurality of traction elements 20. The cylindrical elements may be attached to the prism of one of the traction elements opposite a base side 68, the base side being attached to the surface 62 of the interior circumference 18 of the drum 16. The cylindrical elements have a large length to diameter ratio. Thus, the cylindrical elements are also called fingers 64. The fingers act as an additional impediment to any of the plurality of balls rolling off the traction element to which the fingers are attached.

The plurality of traction elements 20 may be solid, or may be hollow. It is only critical that the two sides of the prism extending toward the interior 56 of the drum 16 from the surface 62 of the interior circumference 18 of the drum be present to provide additional friction for the plurality of balls 22.

Traction elements 20 with and without fingers 64 may be mounted on the surface 62 of the interior circumference 18 of the drum 16 in an alternating pattern. Alternatively, the traction elements with and without fingers may be mounted in a pattern of two of one and one of the other, or three of one and one of the other, or any other pattern which provides the desired movement of the plurality of balls 22 when the drum is rotated.

Each of the plurality of balls 22 is a single solid color. However, there are a plurality of colors among of the plurality of balls in the interior 56 of the drum 16. The ratio of each color to another varies from embodiment to embodiment.

A control panel 70 is placed in a second aperture 72 in the lower section 26 of the cabinet 12. This second aperture positions the control panel such that it will be accessible to a user in order to play the game, and is thus on a proximal side 74 of the cabinet. The control panel comprises controls 76 that allow the user to rotate the drum clockwise or counterclockwise. The controls may be a rotatable bar 78 with a rotation direction of the bar corresponding to the rotation direction of the drum or may be a set of buttons (not shown), with each of the set of buttons corresponding to a different rotation direction. The control panel further comprises optional controls 80 for other functions such as selecting particular aspects of game play.

At least one tray 36 may be attached to the field of play 34. The at least one tray is generally parallelepiped shaped with a width greater than the outside diameter of one of the plurality of balls 22. A length of each of the at least one retention tray may be equal or may vary from a length just over the outside diameter of one of the plurality of balls to a length just greater than 12 times the outside diameter of one of the plurality of balls. A top side 82 of the at least one tray is open. The height of the tray from a side opposite the open side to the open side is at least half a diameter of one of the plurality of balls. The remaining sides of the at least one tray may be solid or may have openings smaller than one of the plurality of balls. The at least one tray is attached on a side to the field of play. In one embodiment, a plurality of trays may be placed side by side on the field of play. In other embodiments, there may be a single tray on the field of play. In still other embodiments, the trays may be placed in a pattern which is symmetrical about the horizontal axis. For example, at a point spaced in from the apex of the drum, a first row including one tray is placed. Spaced below the row of one tray, a second row of two trays is placed. Spaced a distance equal to the spacing between the first and second rows below the second row, a third row of three trays is placed in field of play. A fourth row is placed an equal distance below the third row, and contains two trays. Finally, a fifth row spaced equally below the fourth row is attached to the field of play and includes one tray. Each row of the trays are centered on a vertical diameter of the drum 16. Some trays may be colored to correspond to colors of the plurality of balls 22 in play.

In an alternative embodiment, there may be a single basket in the middle of the field of play and three concentric circles of lights on the field of play 34. Each concentric circle represents a different possible score based on the color of the next ball of the plurality of balls 22 which is next captured on the field of play. The color least represented among the plurality of balls corresponds with the highest available score, the next least represented color among the plurality of balls corresponds with the next highest available score, and the most common color corresponding to the lowest available score. The score may change in a random manner controlled by the cpu 94, and the score available for a ball of the corresponding color indicated by one light on each the concentric circles of lights.

In rows with multiple trays 36, the trays are spaced horizontally apart from each other at equal distances. The equal distances are slightly less than the width of an individual tray. The at least one retention tray serves to catch the plurality of balls 22 which fall in to the tray during rounds of gameplay.

Alternatively, the spacing of individual trays 36 may be altered in the lower rows to compensate for the altered fall of the plurality of balls 22 due to the presence of the trays above. Individual trays in a row may be raised or lowered, or the horizontal spacing between trays in the same row altered to bring the trays closer together or farther apart.

The drum 16 may be driven by two electric motors 84. The electric motors are each connected to a common gear 86 with multiple slots 88 by a belt 90. Each belt corresponds to one of the multiple slots. The common gear freely rotates about an axle 60 which is supported by a stand column 92. The common gear is connected to the drum. Each motor turns, through the belt and gears, the drum in a single direction; one motor turns the drum clockwise, the other motor turns the drum counterclockwise. The electric motors are also connected to a central processing unit (cpu) 94, which is also connected to the above-described controls 76. Through the cpu, some the controls, for example, the rotatable bar 78 operate the two electric motors to turn the drum.

Toward a distal end 96 of the axle 60, the axle may be connected to a second gear 98 which is turned by a chain 100. The chain is also connected to a third, smaller electric motor 102. This motor is software controlled, and at predetermined times during gameplay, the motor will activate to rotate the field of play 34 at least 90 degrees, as described above.

In another embodiment, the ticket redemption game comprises at least one retention tube 38. A plurality of retention tubes 38 may be placed side by side on the field of play 34. The at least one retention tube is substantially cylindrical, with an inside diameter greater than the outside diameter of one of the plurality of balls. A lower end of the retention tube is selectively capped during game play. That is, during a round of game play, one end, usually a low end 104 of the retention tube is blocked by a cap 106 to prevent the plurality of balls from passing through the retention tube and exiting the end of the retention tube. The at least one retention tube may be automatically uncapped by the cpu 94 after a round of game play is complete. Rounds of game play are completed when certain criteria are met. These criteria will be described in more detail below.

The cap 106 may be a single piece for capping the at least one retention tube 38. In embodiments with a plurality of retention tubes, a single piece cap piece may be sized and shaped to cap a plurality of retention tubes. In the capped position, the at least one retention tube is generally vertical, and the cap is generally horizontal. The cap may be of any size and shape, as long at it prevents the plurality of balls 22 from exiting the at least one retention tube.

The at least one retention tube 38 moves from a capped position to an uncapped position. In one embodiment, the at least one retention tube is uncapped by tilting the at least one retention tube. At the end of a round of game play, the end of the tube closest to the cap 106 rotates outward from the field of play until the capped end of the at least one retention tube is clear of the cap. That is, the at least one retention tube rotates around an axis near the uncapped end, with the uncapped end moving less, and the capped end of the at least one retention tube moving through a larger arc. Once the end of the tube nearest the cap is clear of the cap, the any of the plurality of balls 22 pass from the tube and, under the force of gravity, the balls fall to rest in the low point 42 of the drum 16.

In other embodiments, the cap 106 may rotate from a capped position to an open position. The cap is hinged at the point or segment nearest the field of play 34. In the capped position, the cap rests horizontally, at or very near the low end 104 of the at least one retention tube. When activated, such as at the end of a round of game play, the cap moves to an open position, rotating around the hinge, moving downward and to a vertical orientation where the cap is generally parallel to the field of play.

The at least one retention tube 38 may be placed vertically within the interior 56 of the drum 16. That is, the longitudinal axis of the at least one retention tube may be perpendicular to that of the axis about which the drum rotates. In some embodiments, the at least one retention tube is placed against the field of play 34. In other embodiments, the at least one retention tube may be suspended from the field of play at a pre-determined distance. The at least one retention tube may include markings 108 which bear on game play.

The ticket redemption game 10 may also include a blocking element 110. The blocking element may be placed at the end of the at least one retention tube 38 opposite the end that is capped during a round of game play. In some embodiments the blocking element is integrated with the field of play 34. In other embodiments, it may be separate from the field of play. In either of the embodiments, the blocking element has two states, a preparatory state, and an activated state. In a preparatory state, the blocking element is clear of the open end of the at least one retention tube. In an activated state, the blocking element is repositioned such that it blocks access to the retention tubes by the plurality of balls 22. In some embodiments, the blocking element directs blocked balls toward the bottom of the drum. In other embodiments the blocking element directs balls in a random direction.

In one embodiment, the blocking element 110 is a plate 112 and a hinge 114. The plate has a length corresponding to the combined diameters of the at least one retention tube and a width greater than the diameter of the at least one retention tube. The plate is hinged along the edge opposite that closest to the at least one retention tube. An actuator 116 is attached the plate. The actuator is user controllable.

In a preparatory state, the blocking element 110 lays flat against the field of play 34. In an activated state, the plate 112, via the hinge 114 and actuator 116, changes position, with the edge opposite the hinged edge rotating outward from field of play, until the edge of the plate opposite the hinge is approximately even with an imaginary line drawn tangent to the circumference of the at least one retention tube. Thus, the blocking element in an activated state prevents any of the plurality of balls 22 from entering the at least one retention tube 38.

The blocking element 110 may be user controlled. Alternatively, the blocking element may be randomly moved between a preparatory and an activated state. In still other embodiments the blocking element may be both randomly moved between a preparatory and an activated state, and when not randomly in an activated state, be controlled by a user. In some embodiments the control 76 is a button located on the control panel 70, or on another control extending from the panel. Alternatively, the control may be a footswitch (not shown) located on a base of the cabinet 12.

In still other embodiments, the ticket redemption game 10 may include both at least one tray 36 and at least one retention tube 38. The ticket redemption game may have as many as 36 retention trays or 36 retention tubes or any combination of retention trays and tubes adding to a total of 36.

In operation, a round of gameplay begins when all of the plurality of balls 22 are resting at the low point 42 of the drum 16, if present, the at least one retention tube 38 is capped, and the blocking element 110 is not activated. The user may add tokens or money in to a token or money slot 118 in the cabinet 12. Alternatively or additionally, the ticket redemption game 10 may include a card reader 120 for processing credits to activate the game. A coin sensor in the slot, or the card reader is connected electronically to the cpu 94. Once the game is activated, the user initiates movement of the drum 16 by activating the control 78 to spin the drum clockwise or counterclockwise. This initiation of movement also causes a countdown clock 122, which is electrically connected to the cpu, to start. The plurality of balls 22 are carried to the apex 40 of the drum 16 and gravity causes the plurality of balls to fall from the apex toward the at least one tray 36 or at least one retention tube 38. Some of the portion of the plurality of balls will enter the at least one tray or at least one retention tube and move through the at least one tray or at least one retention tube until the ball either contacts the bottom of the tray or the capped end of the retention tube or another ball already resting within the tube. Alternatively, each of the plurality of balls may move through the field of play 34 until the ball reaches the low point 42 of the drum.

Scoring within the game is based on the number of a pre-designated color of balls of the plurality of balls 22 within a single tray 36 or tube 38, the position of a pre-designated color of ball in relation to a mark on the tube, or the alignment of a number of a pre-designated color of balls across a plurality of trays or retention tubes.

Sensors 44 placed within the cabinet 12 detect the number of plurality of balls 22, the color of each ball, and placement of balls within the at least one tray 36 or at least one retention tube 38. The sensors are electronically connected to the cpu 94, which then determines the totals of any specific color of the balls in the at least one tray or at least one retention tube and determines any additional score based on changes in what the sensor detects.

If any of the at least one tray 36 or at least one retention tube 38 is not filled, and the countdown clock 122 has not reached zero, the user may select to spin the drum 16 again, either clockwise or counterclockwise, and position additional balls to fall into the at least one tray or at least one retention tube. In one embodiment, if the user wishes to block balls from entering the at least one retention tube, the user may activate the blocking element 110.

The round of play continues in this manner until one of two conditions is met. Either the at least one tray 36 or at least one retention tube 38 or the combination thereof are completely filled, or the countdown clock 122 reaches zero. When one of these conditions is met, either the sensors 44 signaling the cpu 94, or the countdown clock 122 signals the cpu, and the cpu stops play, and based on data provided by the sensors, the cpu calculates the score for that round of game play. In some embodiments, the player can choose to continue the round of gameplay by buying additional time, using the slot 118 or card reader 120, when the countdown clock reaches zero.

The score is then displayed on a screen 124 electronically connected to the cpu 94, which may also be called simply a processor 94, and placed in another aperture within the cabinet 12. The processor determines the number of tickets to dispense from a ticket dispenser 126 based on the calculated score. For some embodiments, the processor may award a prize rather than tickets. The prize may be stored in the interior 48 of the cabinet 12, and dispensed through a prize chute (not shown) in the cabinet. In other embodiments, the processor may award both prizes and tickets based on calculated score. In still other embodiments, the processor may award tickets or prizes based on pre-determined conditions. Tickets are dispensed to the user through a ticket dispenser placed in another aperture in the cabinet.

The above description is given by way of example, and not limitation. Given the above disclosure, one skilled in the art could devise variations that are within the scope and spirit of the invention disclosed herein, including various ways of moving the balls within the cabinet. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A ticket redemption game, comprising:

a cabinet;

a cylindrical drum placed inside the cabinet defining an apex, a low point, and an interior circumference;

a plurality of traction elements attached to the interior circumference at regular intervals;

a field of play defining an exterior circumference, the field of play being separated from the cylindrical drum by a gap, and comprising at least one retention element;

a plurality of balls placed within the cylindrical drum; and a control located on an exterior of the cabinet and connected to the cylindrical drum;

wherein, when a user operates the control, the user ma rotate the cylindrical drum selectively clockwise or counterclockwise at au time during play, when rotating either clockwise or counterclockwise the cylindrical drum and the traction elements carry the plurality of balls around the exterior circumference, the plurality of bells entering the field of play under momentum provided by the rotation, and if one of the plurality of balls is not captured by the at least one retention element, the one of the plurality of balls returns to the low point under the force of gravity, and where any one of the plurality of balls may enter the field of play from any point on the exterior circumference.

2. The ticket redemption game of claim 1, further comprising a countdown clock.

3. The ticket redemption game of claim 1, further comprising at least one electric motor for rotating the cylindrical drum.

4. The ticket redemption game of claim 2, further comprising two electric motors for rotating the drum, wherein each electric motor rotates the drum in a single direction.

5. The ticket redemption game of claim 1, wherein the field of play is fixed to an axle.

6. The ticket redemption game of claim 5, further comprising an electric motor connected to a chain.

7. The ticket redemption game of claim 6, wherein the chain turns the axle to rotate the field of play.

8. The ticket redemption game of claim 7, wherein the electric motor is controlled by a central processing unit.

9. The ticket redemption game of claim 1, wherein the control is a rotatable handle.

10. A ticket redemption game, comprising: a cabinet; a cylindrical drum placed inside the cabinet; a plurality of traction elements attached to an interior circumference of the rotating cylindrical drum; a field of play defining an exterior circumference separated from the rotating cylindrical drum by a gap and including no structure which impedes any of a plurality of balls placed in the cylindrical drum entering the field of play from any point on the exterior circumference; a first electric motor connected to the rotating cylindrical drum, and configured to rotate the rotating drum exclusively clockwise; a second electric motor connected to the drum, and configured to rotate the drum exclusively counterclockwise; and a third electric motor connected to the field of play, and configured to rotate the field of play.

11. The ticket redemption game of claim 10, wherein the first electric motor is connected to the cylindrical drum by a first belt and the second electric motor is connected to the cylindrical drum by a second belt.

12. The ticket redemption game of claim 1, wherein the first belt and the second belt are placed in a corresponding first slot and second slot in a common gear.

13. The ticket redemption game of claim 10, further comprising fingers attached to at least one of the traction elements.

14. The ticket redemption game of claim 13, further comprising fingers attached to half of the traction elements.

15. The ticket redemption game of claim 10, further comprising at least one retention element attached to the field of play.

16. The ticket redemption game of claim 10, further comprising at least one retention tube attached to the field of play.

17. The ticket redemption game of claim 10, further comprising a card reader electrically connected to a central processing unit.

18. A method for manufacturing a ticket redemption game, comprising: forming a cabinet; placing a cylindrical drum inside the cabinet, the cylindrical drum defining an interior circumference; arranging a plurality of traction elements around the interior circumference; placing a plurality of balls in the cylindrical drum; connecting an axle to the cabinet; connecting a field of play to the axle, the field of play defining a field of play circumference spaced apart from the cylindrical drum, and the field of play allowing any one of the plurality of balls to enter the field of play circumference at any point on the field of play circumference; connecting the drum to at least one electric motor; connecting, electrically, the at least one electric motor to a central processing unit; and connecting, electrically, the central processing unit to a user control.

19. The method of claim 18, wherein at least one of the plurality of traction elements comprises at least one finger.

20. The method of claim 18, wherein the plurality of balls comprise bells of at least three colors.

* * * * *